US005888098A

United States Patent [19]

Cheng et al.

[11] Patent Number: 5,888,098

[45] Date of Patent: Mar. 30, 1999

[54] FUSE HOLDER DEVICE

[76] Inventors: Wen-Tzung Cheng, No. 422, Fu-Hsing Rd.; Wen-Huoh Cheng, No. 424, Fu-Hsing Rd., both of Tao Yuan Hsien, Taiwan

[21] Appl. No.: 991,847

[22] Filed: Dec. 16, 1997

[30] Foreign Application Priority Data

Oct. 24, 1997 [TW] Taiwan ..... 86218062

[51] Int. Cl.[6] ..... H01R 13/68

[52] U.S. Cl. ..... 439/621

[58] Field of Search ..... 439/621, 622

[56] References Cited

U.S. PATENT DOCUMENTS

| | | | |
|---|---|---|---|
| 4,762,510 | 8/1988 | Schaefer | 439/622 |
| 4,909,761 | 3/1990 | Muguira | 439/622 |
| 4,981,448 | 1/1991 | Herbert | 439/621 |
| 5,018,991 | 5/1991 | Katz et al. | 439/621 |
| 5,648,749 | 7/1997 | Lin et al. | 439/622 |
| 5,772,473 | 6/1998 | Cheng et al. | 439/621 |

*Primary Examiner*—Hien Vu
*Assistant Examiner*—Briggitte R. Hammond
*Attorney, Agent, or Firm*—Rosenberg, Klein & Bilker

[57] ABSTRACT

A fuse holder device including a casing, at least one pair of substantially cylindrical terminals respectively mounted inside the casing, each terminal having a split receptacle at one end adapted to receive one end of a respective fuse and an electric wire receptacle at an opposite end adapted to receive one end of a respective electric wire, at least one fuse respectively connected between the at least one pair of terminals, a plurality of electric wires respectively connected to the terminals at two opposite ends of each fuse, and a plurality of clamps respectively mounted around the electric wires inside the casing to secure the electric wires to the terminals.

4 Claims, 11 Drawing Sheets

FUSE HOLDER DEVICE

BACKGROUND OF THE INVENTION

The present invention relates to a fuse holder device which uses terminals and clamps to secure electric wires to fuse means rapidly.

FIG. 1 shows a fuse and electric wire mounting arrangement according to the prior art. This arrangement comprises a casing 10', two fuse holders 11' disposed inside the casing 10' near its two opposite ends, the fuse holders 11', a cartridge fuse 13' connected between the fuse holders 11'. Each fuse holder 11' has a first plug hole 12' at an inner side adapted to hold one end of the cartridge fuse 13', and a second plug hole 14' at an outer side adapted to receive an electric wire. When the conductors of two electric wires are respectively inserted into the second plug holes 14' on the fuse holders 11', tightening up screws 15' are threaded into respective screw holes on two opposite ends of the casing 10' into respective radial through holes on the fuse holders 11' to fix the inserted electric wires in place. Before the installation of the electric wires, the insulators must be removed from the lead ends of the electric wires, so that the conductors of the lead wires can be exposed to the outside and inserted into the second plug holes 14' on the fuse holders 11' inside the casing 10'. This installation procedure is complicated, and the installation cost of the arrangement is high.

SUMMARY OF THE INVENTION

The present invention has been accomplished to provide a fuse holder device which eliminates the aforesaid drawbacks. It is one object of the present invention to provide a fuse holder device which is economical. It is another object of the present invention to provide a fuse holder device which is easy to install. To achieve these and other objects of the present invention, there is provided a fuse holder device which comprises a casing, at least one pair of terminals respectively mounted inside the casing, each terminal having a split receptacle at one end adapted to receive one end of a respective fuse and an electric wire receptacle at an opposite end adapted to receive one end of a respective electric wire, at least one fuse respectively connected between the at least one pair of terminals, a plurality of electric wires respectively connected to the terminals at two opposite ends of each fuse, and a plurality of clamps respectively mounted around the electric wires inside the casing to secure the electric wires to the terminals.

DETAILED DESCRIPTION OF THE PREFERRED EMBODIMENT

Figure 1:
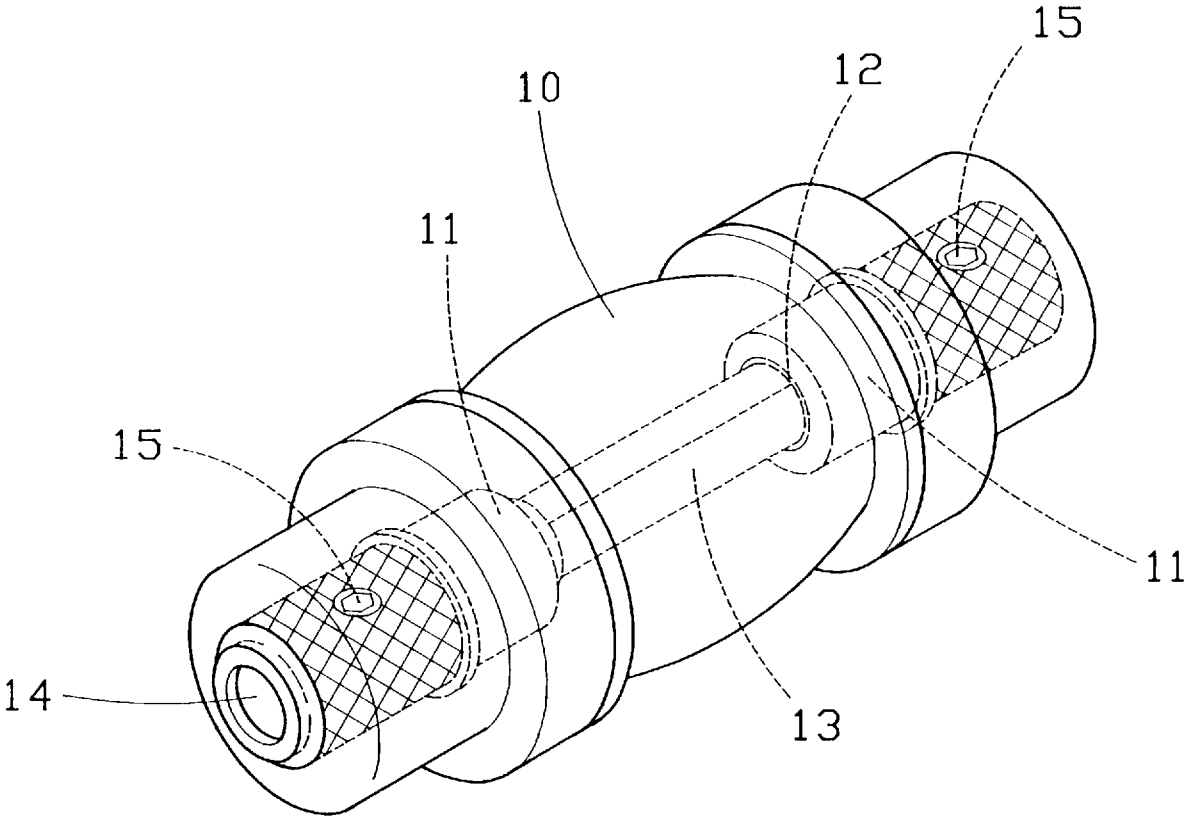
FIG. 1 PRIOR ART
FIG. 1 is a perspective view of a fuse and electric wire mounting arrangement according to the prior art.
Figure 2:
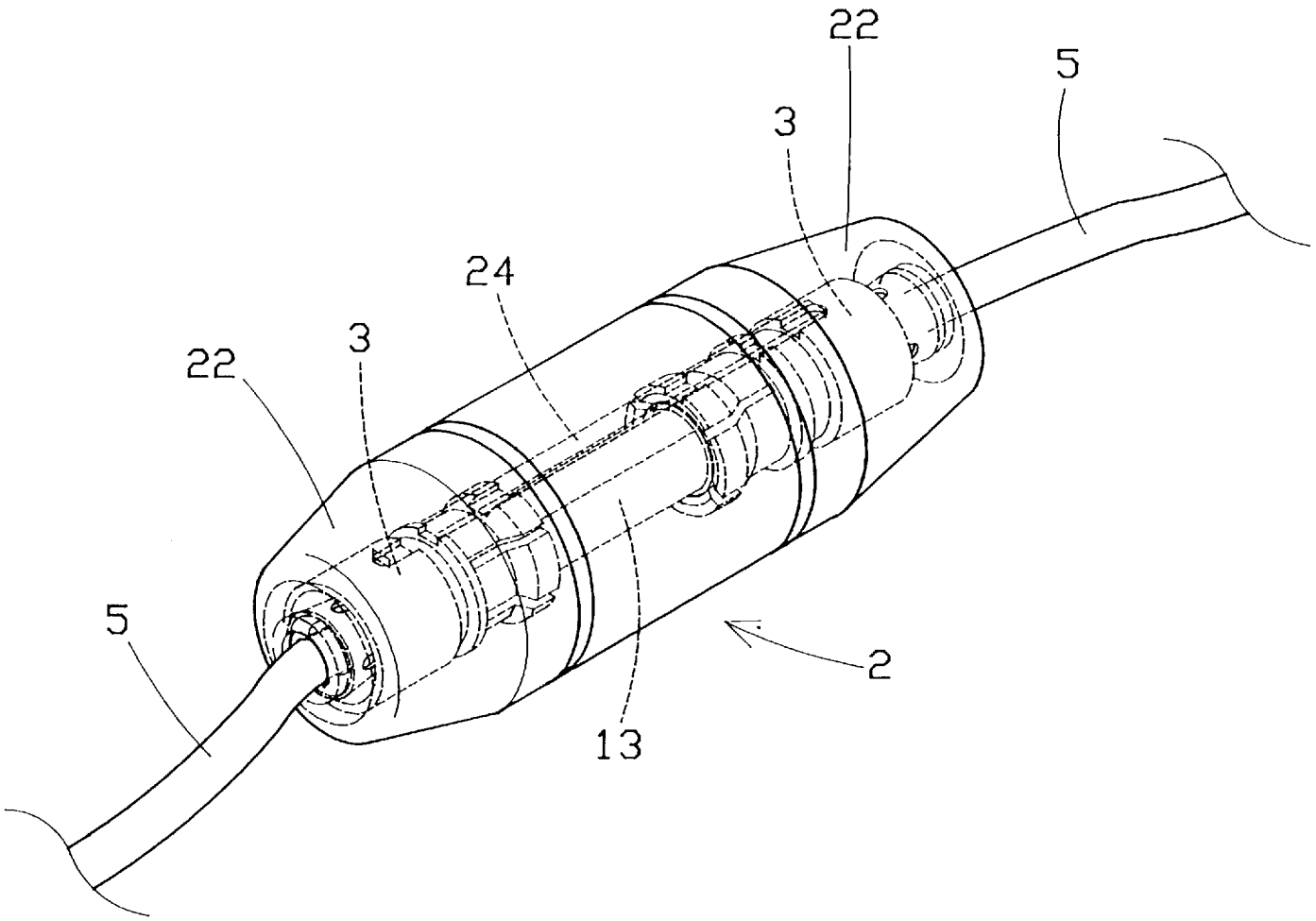
FIG. 2 is a perspective view of a fuse and electric wire mounting arrangement according to the present invention.
Figure 3:
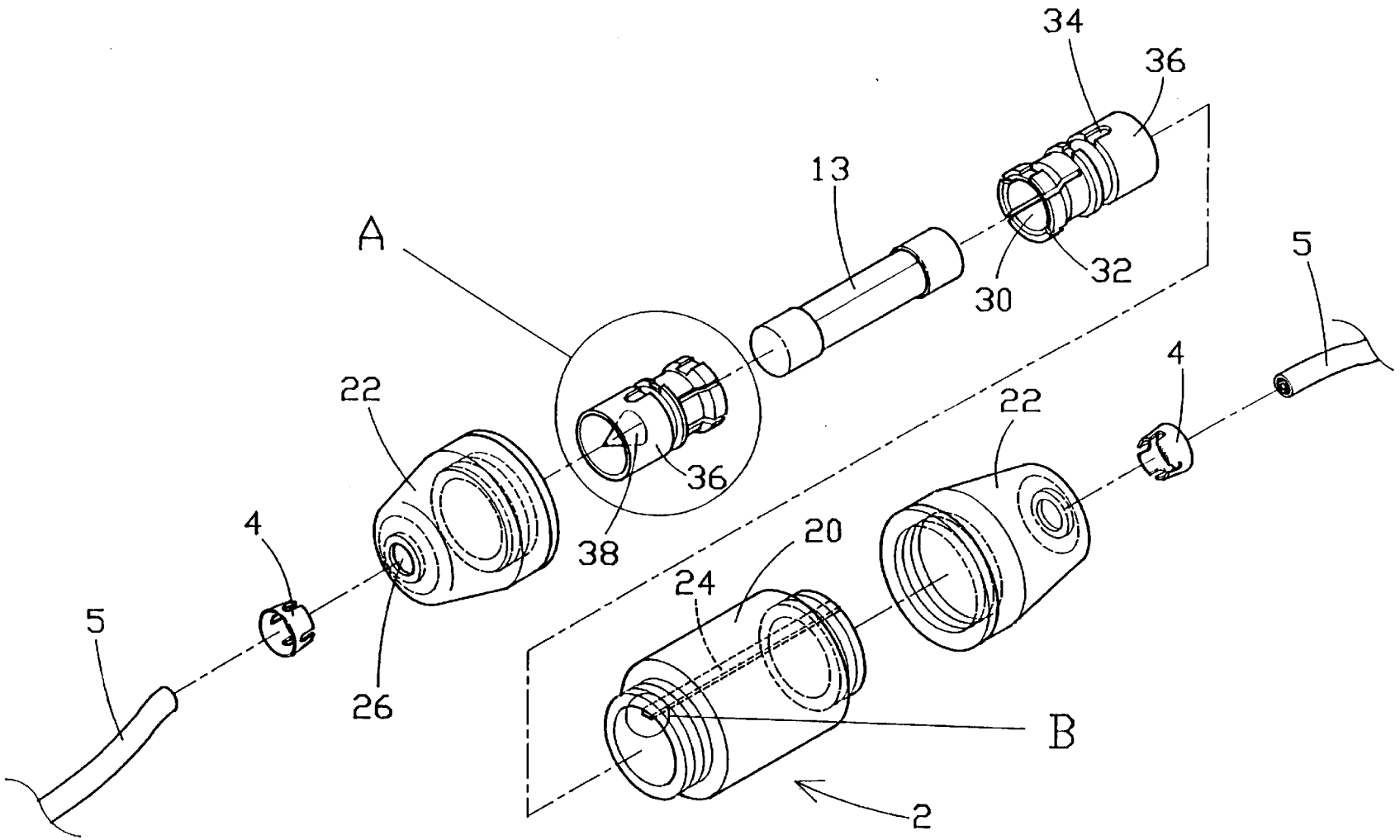
FIG. 3 is an exploded view of the fuse and electric wire mounting arrangement shown in FIG. 2.
Figure 3A:
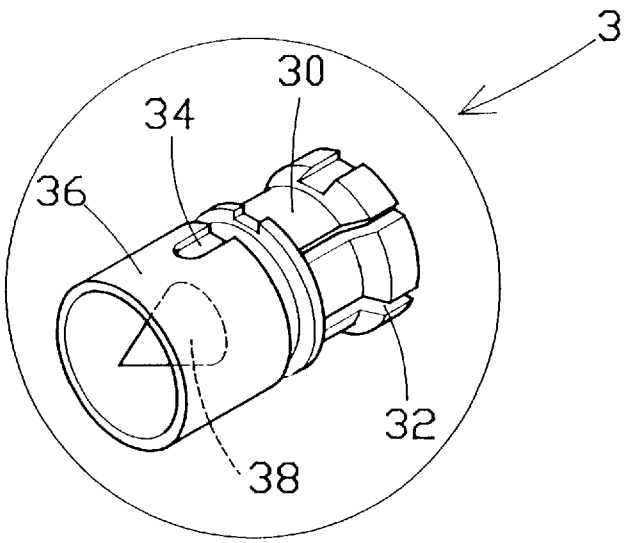
FIG. 3A is an enlarged view of a part of FIG. 3, showing the structure of the terminal.
Figure 3B:
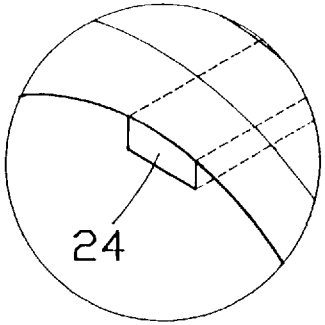
FIG. 3B is an enlarged view of a part of FIG. 3, showing the structure of the longitudinal rib inside the body of the casing.
Figure 4:
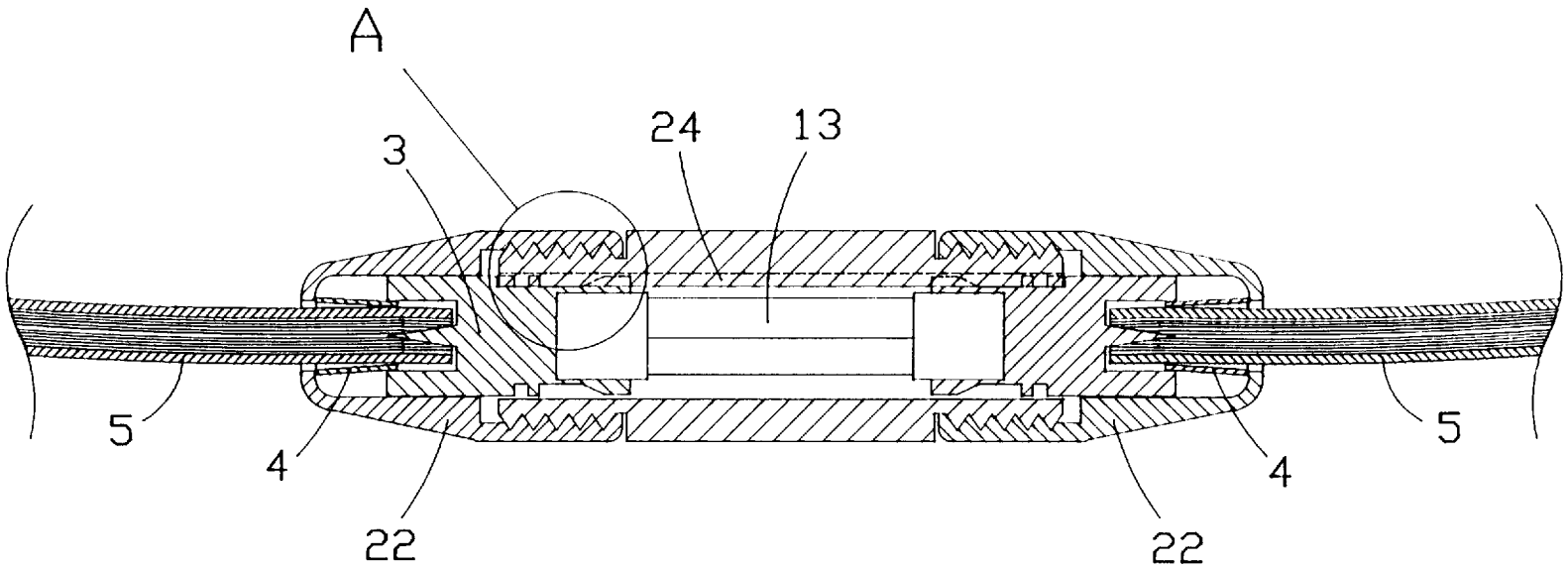
FIG. 4 is a longitudinal view in section of FIG. 2.
Figure 4A:
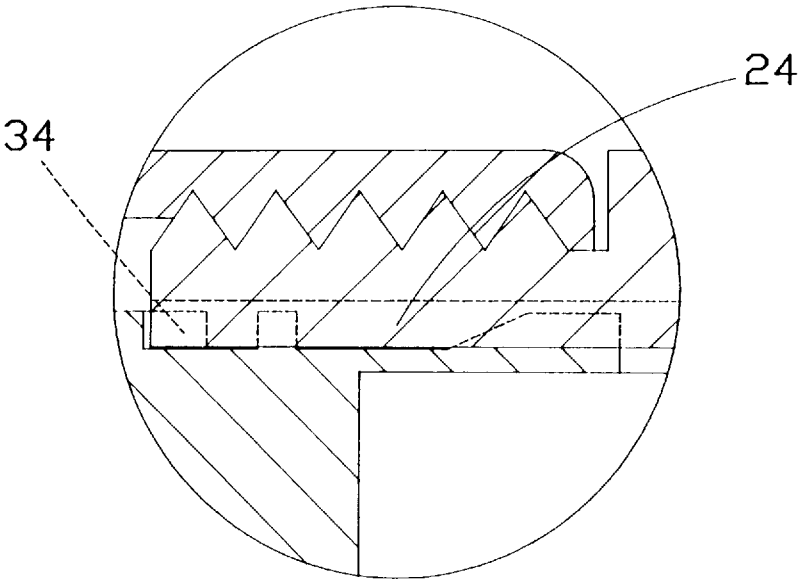
FIG. 4A is an enlarged view of a part of FIG. 4, showing the engagement between the longitudinal rib on the body of the casing and the longitudinal groove on the terminal.

Referring to FIG. 2 and 3, a fuse holder device in accordance with the present invention is generally comprised of a casing 2, two substantially cylindrical terminals 3, two clamps 4, a cartridge fuse 13, and two electric wires 5.

Referring to FIGS. 3A, 3B, 4 and 4A, and FIGS. 2 and 3 again, the casing 2 is comprised of a hollow cylindrical body 20, and two end caps 22 respectively fastened to two opposite ends of the cylindrical body 20 by a screw joint. The body 20 comprises a longitudinal rib 24. The end caps 22 have a respective center through hole 26 adapted to receive the electric wires 5. The terminals 3 are made from metal for example copper, and respectively fastened to the electric wires 5 inside the casing 2. Each terminal 3 comprises a first receptacle 30 at one end, a plurality of longitudinal splits 32 at the first receptacle 30, a second receptacle 36 at an opposite end, a longitudinal coupling groove 34 extended through the periphery of the first receptacle, and a pointed tip 38 inside the second receptacle 36. The cartridge fuse 13 is mounted inside the casing 2, and connected between the terminals 3. Because the first receptacle 30 is provided with longitudinal splits 32, it can be expanded radially. When one end of the cartridge fuse 13 is inserted into the first receptacle 30 of one terminal 3 the first receptacle 30 is expanded radially for permitting the cartridge fuse 13 to be set into position. When the terminals 3 are installed in the casing 2, the longitudinal grooves 34 of the terminals 3 are respectively forced into engagement with the longitudinal rib 24 of the body 20 of the casing 2, and therefore the terminals 3 are prohibited from a rotary motion relative to the casing 2. The electric wires 5 are respectively inserted through the through holes 26 of the end caps 22 into the second receptacles 36 of the terminals 3, and secured in place by the clamps 4. When the electric wires 5 are respectively inserted into the second receptacles 36 of the terminals 3, the pointed tips 38 of the terminals 3 are respectively forced into contact with the inside conductors of the electric wires 5. The clamps 4 are respectively mounted around the electric wires 5 in the through holes 26 inside the end caps 22, and partially plugged into the second receptacles 36 of the terminals 3 to fix the electric wires 5 to the terminals 3.

Figure 5:
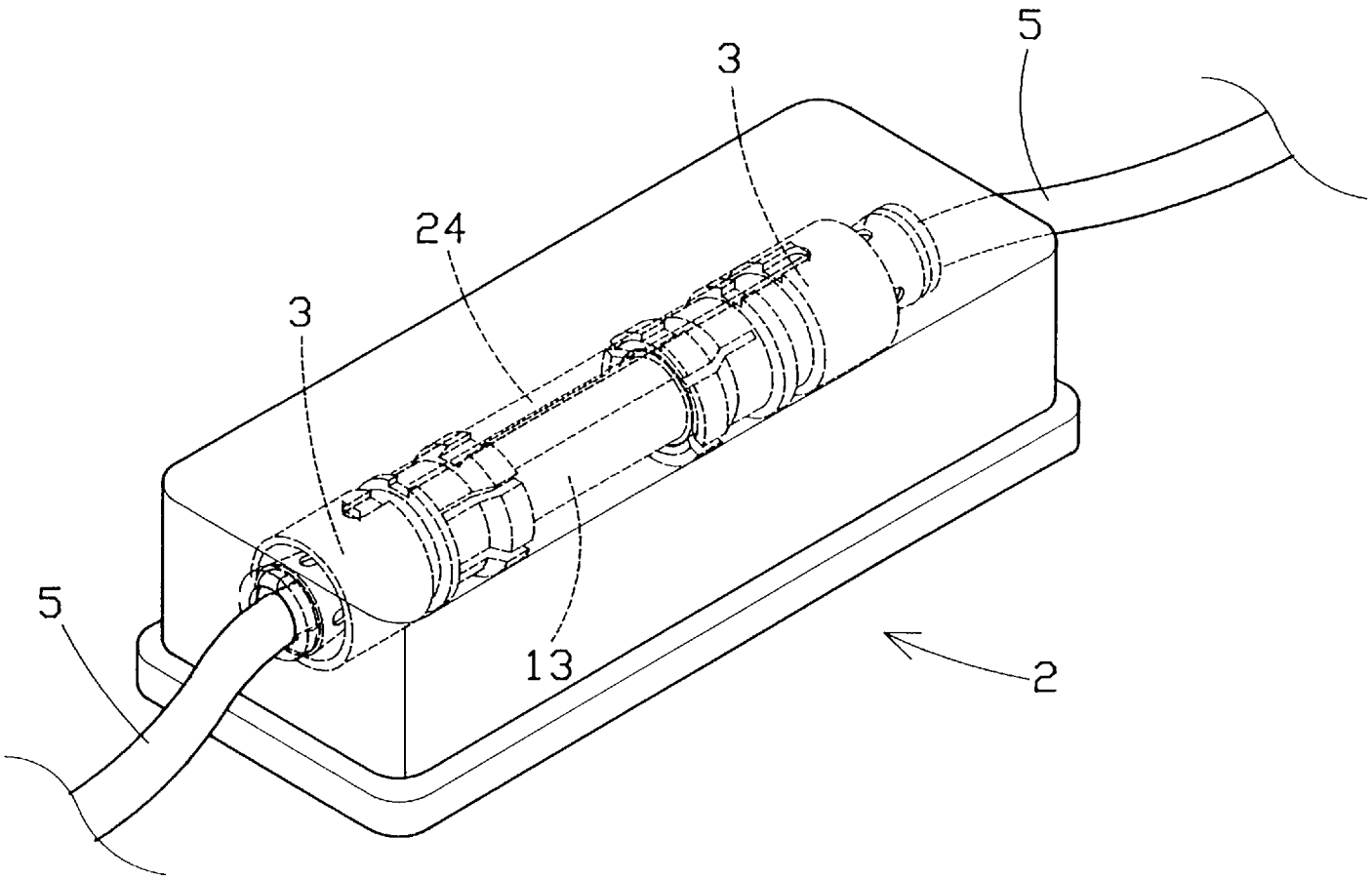
FIG. 5 is a perspective view of an alternate form of the present invention.

FIG. 5 shows an alternate form of the present invention, in which the casing 2 has a rectangular shape.

Figure 6:
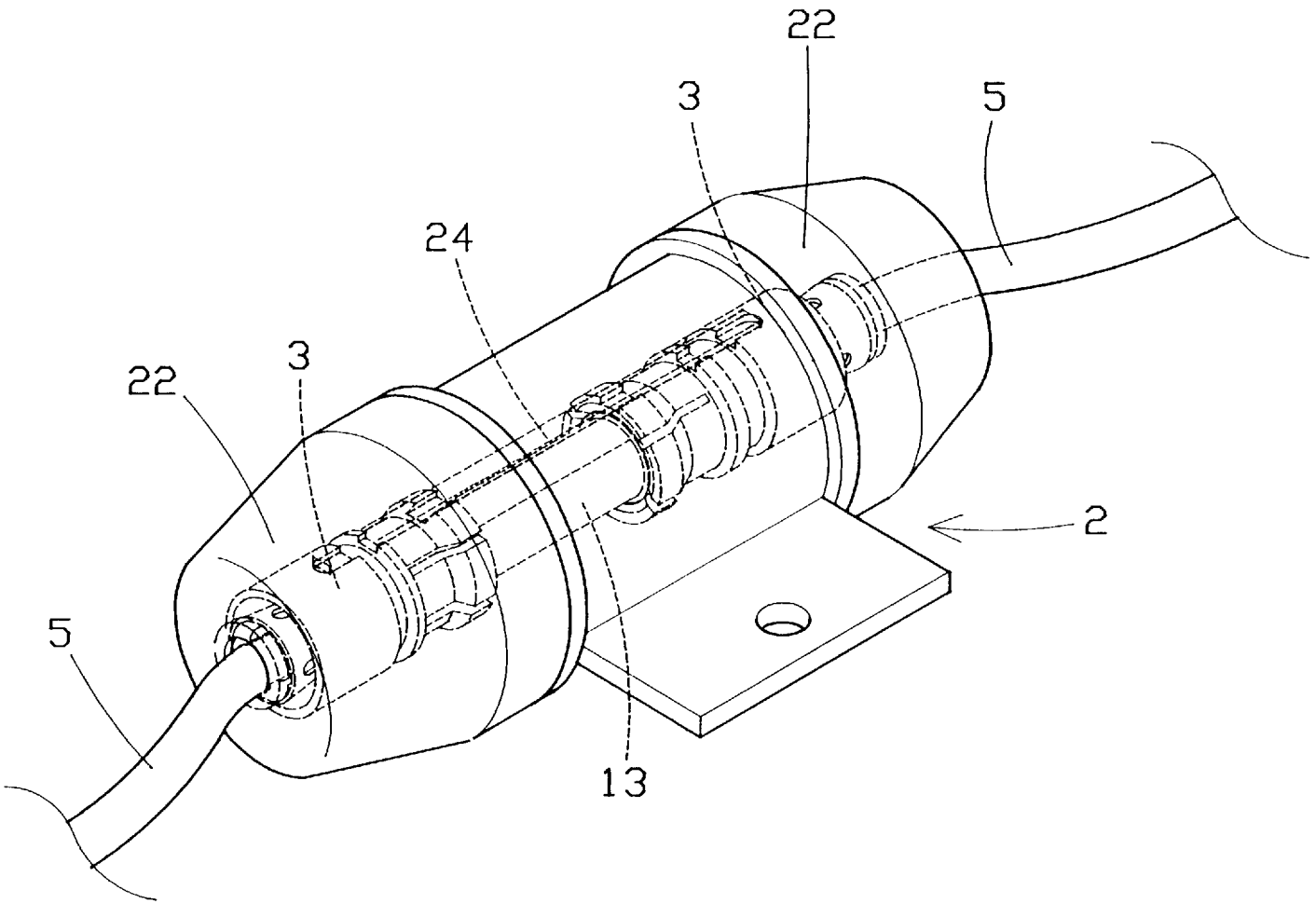
FIG. 6 is a perspective view of still another alternate form of the present invention.

FIG. 6 shows another alternate form of the present invention. This alternate form is similar to that shown in FIG. 2, however the casing 2 is provided with a mounting plate adapted for securing to for example a wall.

Figure 7:
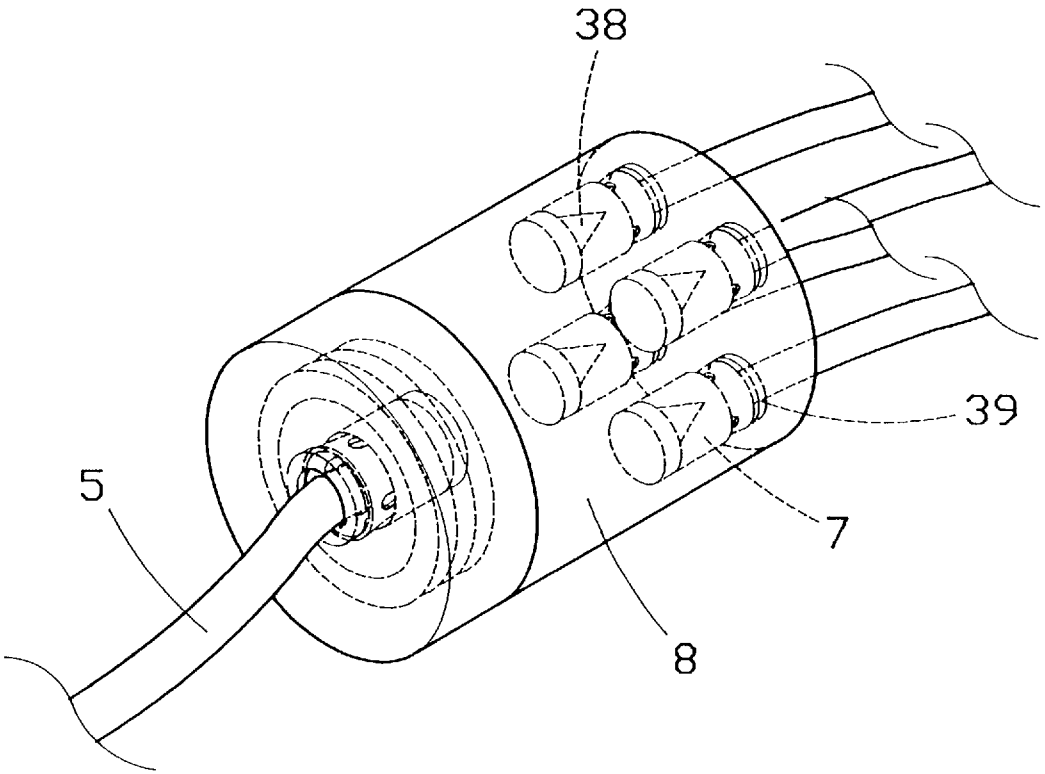
FIG. 7 is a perspective view of still another alternate form of the present invention.

FIG. 7 shows still another alternate form of the present invention, in which a plurality of terminals 7 are respectively mounted in respective plug holes 39 inside an electrically conductive block 8 to hold a respective electric wire 5, each terminal 7 having a pointed tip 38 on the inside forced into contact with a conductor in the respective electric wire 5.

Figure 8:
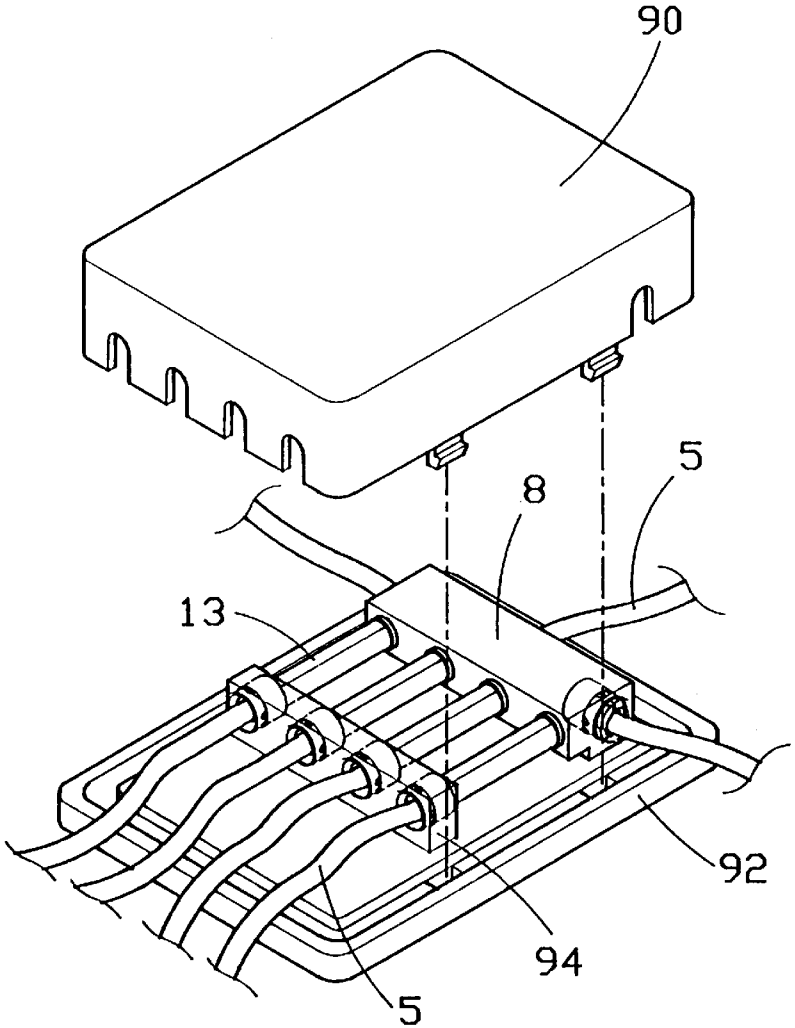
FIG. 8 is a perspective view of still another alternate form of the present invention.

FIG. 8 shows still another alternate form of the present invention, in which a plurality of cartridge fuses 13 are mounted between electrically conductive blocks 8;94 on an electrically insulative bottom shell 92; electric wires 5 are respectively fastened to terminals (not shown) in the electrically conductive blocks 8;94 by clamps (not shown), and an electrically insulative cover shell 90 is covered on the electrically insulative bottom shell 92.

It is to be understood that the drawings are designed for purposes of illustration only, and are not intended as a definition of the limits and scope of the invention disclosed.

What the invention claimed is:

1. A fuse holder device comprising:

a casing having at least one longitudinal rib therein;

at least one pair of substantially cylindrical terminals respectively mounted inside said casing and being prevented from a rotary motion relative to said casing by said at least one longitudinal rib, each of said at least one pair of terminals having a longitudinal groove forced into engagement with said at least one longitudinal rib inside said casing, a split receptacle at one end of said substantially cylindrical terminals adapted to receive one end of at least one fuse, and an electric wire receptacle at an opposite end of said substantially cylindrical terminals adapted to receive one end of an electric wire;

said fuse connected between said at least one pair of terminals;

a plurality of electric wires respectively connected to said terminals at two opposite ends of said fuse; and a plurality of clamps respectively mounted around said electric wires inside said casing to secure said electric wires to said terminals.

2. The fuse holder device of claim 1, wherein said casing comprises a hollow cylindrical body, and two end caps respectively fastened to two opposite ends of said hollow cylindrical body by a screw joint.

3. The fuse holder device of claim 1, wherein the electric wire receptacle of each of said at least one pair of substantially cylindrical terminals has a pointed tip therein, which is forced into contact with conductor means inside the respective electric wire.

4. The fuse holder device of claim 1, wherein said casing comprises an electrically insulative bottom shell, and an electrically insulative cover shell covered on said electrically insulative bottom shell, said electrically insulative bottom shell comprising two electrically conductive blocks arranged in parallel, said electrically conductive blocks having plug holes adapted to receive said at least one pair of substantially cylindrical terminals.

* * * * *